United States Patent [19]

Ishikawa

[11] 4,165,448

[45] Aug. 21, 1979

[54] LOUDSPEAKER WITH IMPROVED VOICE COIL SUPPORT

[76] Inventor: Haruo Ishikawa, 12-35-314, Matsunoki 1-chome, Suginami-ku, Tokyo, Japan

[21] Appl. No.: 892,034

[22] Filed: Mar. 31, 1978

[51] Int. Cl.[2] ..... H04R 9/04

[52] U.S. Cl. ..... 179/115.5 VC

[58] Field of Search ..... 179/115.5 ES, 115.5 VC, 179/115.5 R; 181/171, 172

[56] References Cited

FOREIGN PATENT DOCUMENTS 332730 7/1930 United Kingdom ..... 179/115.5 VC 306839 9/1930 United Kingdom ..... 179/115.5 ES

*Primary Examiner*—George G. Stellar

*Attorney, Agent, or Firm*—Robert E. Burns; Emmanuel J. Lobato; Bruce L. Adams

[57] ABSTRACT

A loudspeaker comprising a voice coil bobbin with a voice coil wound around its periphery and a line spanned so as to surround the voice coil bobbin, which includes hanging zones for passing by the voice coil bobbin and connecting portions for linking the hanging zones. The voice coil bobbin is engaged with the spanned line in such a manner that the voice coil is positioned in a gap between a central pole piece and a yoke. The voice coil bobbin is preferably put on a reinforced ring which is engaged with the line.

4 Claims, 7 Drawing Figures

LOUDSPEAKER WITH IMPROVED VOICE COIL SUPPORT

BACKGROUND OF THE INVENTION

1. Field of the Invention

This invention relates to a loudspeaker of moving coil type, particularly to an improvement in a loudspeaker of type wherein a voice coil bobbin is concentrically suspended by line within a gap of radial magnetic field.

2. Prior Art

Usually, in a loudspeaker having a diaphragm such as cone type, metal type or the like, there have been known as a damper supporting a voice coil bobbin attached to a diaphragm within a gap, for instance, a cloth damper which is impregnated with synthetic resin and concentrically molded by heat, a formed damper made of synthetic resin sheet, a line damper suspended by line and the like. Among such dampers, the line damper is recognized to be able to obtain good reproduced sound. However, as shown in U.S. Pat. No. 3,819,876, etc., the voice coil bobbin is suspended from three directions by three separate lines; therefore it is difficult to keep the tension of lines uniform and the operation is very hard to support the bobbin in a right position without being deformed. For such a reason, when a loudspeaker with a line suspended damper system is once operated, it is liable to cause troubles such that the bobbin is deformed and biased to the annular gap of the radial magnetic field, and because of difficulty in making uniform products, the quality control thereof is hard, thus this system has been hardly adopted by any maker for mass production.

SUMMARY OF THE INVENTION

It is an object of this invention to provide a loudspeaker, which is so arranged that the voice coil bobbin can be suspended by line without being biased into the gap of magnetic field and being deformed.

Another object of the invention is to provide a loudspeaker, which is so arranged that the suspension of line on the voice coil bobbin is effected securely and easily whereas the constant quality and mass production can be assured.

According to this invention, a loudspeaker is provided, which comprises a voice coil bobbin with a voice coil wound around its periphery, a central pole and a yoke forming a gap for positioning the voice coil and a suspension line spanned so as to surround the voice coil bobbin, which includes hanging zones for passing by the voice coil bobbin and connecting portions for linking the hanging zones. The voice coil bobbin is engaged with the spanned line in such a manner that the voice coil is positioned in the above mentioned gap.

Other and further objects, and features of this invention will appear from the following detailed description taken in connection with the accompanying drawing.

DESCRIPTION OF THE PREFERRED EMBODIMENTS

Figure 1:
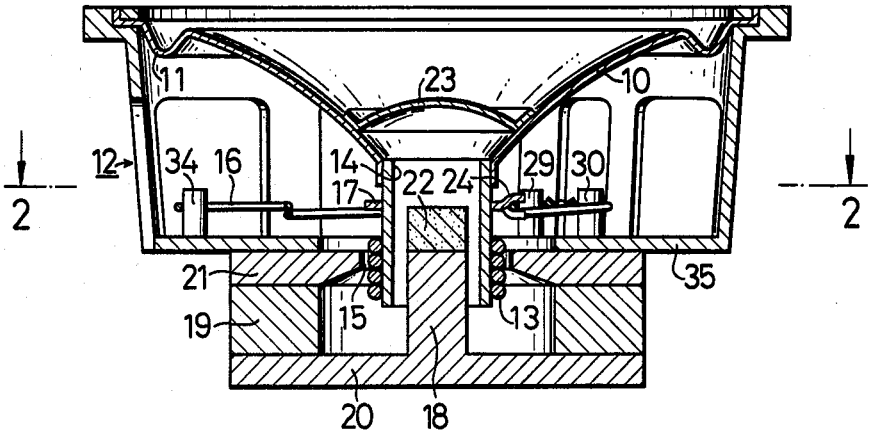
FIG. 1 is a longitudinal section of the loudspeaker according to this invention, taken along line 1—1 of FIG. 2.

In FIG. 1, whole structure of a loudspeaker according to this invention is shown. A diaphragm 10 is attached to a frame 12 at a portion of its edge 11. A voice coil bobbin 14 with a voice coil 13 wound around its periphery is secured to the center of the diaphragm with bonding agent and is suspended by a line 16 so as to position the voice coil 13 within an annular gap 15 of radial magnetic field. When the bobbin is made of strong material, it can be directly suspended by a string; in case of a bobbin shown in Fig., however, a ring 17 is fitted on the periphery of the bobbin and stuck thereon with bonding agent to engage the string with the ring. To form a radial magnetic field for driving the voice coil, a central pole piece 18 is existing within the bobbin, the central pole is concentrically surrounded by an annular magnet 19, the central pole and the magnet are combined by a back yoke plate 20, an annular top yoke plate 21 concentrically surrounding the central pole is secured to the upper end of the magnet, and the voice coil is arranged in the annular gap between the central pole and the top yoke plate. The above magnet may be arranged between the central pole and the back yoke plate. A sound absorbing material 22 is preferably secured on the central pole, thereby better reproduction sound can be obtained.

Figure 2:
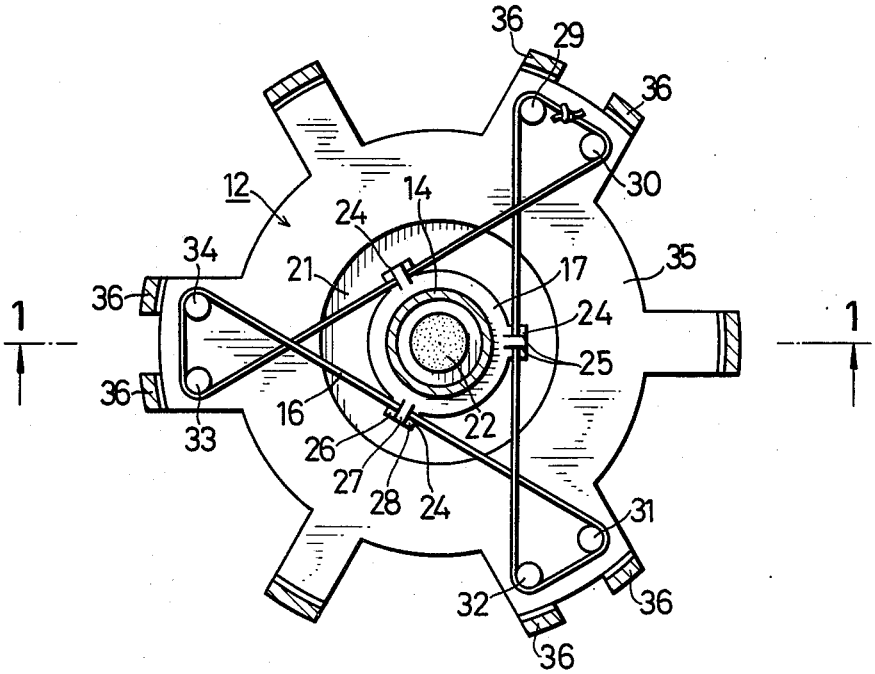
FIG. 2 is a section taken along line 2—2 of FIG. 1.
Figure 3:
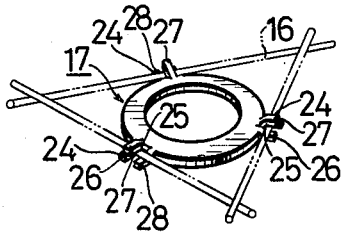
FIG. 3 is a perspective view of a ring attached to a voice coil bobbin shown in FIG. 2.

The front of the bobbin is covered by a cap 23 bound with the diaphragm. The ring 17 is formed into an annular plate with metallic material such as aluminium alloy, brass, etc., or synthetic resin material, and provided with projecting string hangers 24 on the periphery of the ring for hanging the string. As shown in FIGS. 2 and 3, the hangers are radially extending from the periphery of the ring, each extension of the hangers is divided into three pieces 26, 27 and 28 by providing with two slits 25, among which pieces, the intermediate piece 27 is bent upward and the side pieces 26, 28 are bent downward, and between the former and the latter pieces, the string is passed through.

As the string, a polyamide thread or monofilament is used, but other tough and resilient fiber or monofilament made of synthetic resin, silk fiber or yarn, piano wire, etc. may be used.

Struts 29, 30, 31, 32, 33 and 34 are provided on a bottom plate 35 of the frame so as to be dispersed at three portions in pairs on the periphery of the bobbin under equaldistant condition, and the string is spanned among the struts. There are various ways how to span the string. What is shown in FIG. 2 is such that the string 16 is spanned from the strut 29 to the opposite strut 32 passing by the voice coil bobbin 14. Then, the string is spanned around the strut 31 adjacent the strut 32 and passing by the bobbin to the strut 34. Further, the string is spanned around the strut 33 adjacent the strut 34 and passing by the bobbin to the strut 30. Finally, ends of the string are tied together between the struts 29 and 30. Thus, the string is connected integrally, so that the hanging zones of the suspended string are spanned at the connecting portions under uniform tension, and the bobbin is surrounded by the hanging zones of the string spanned in an equilateral triangle shape. The contact parts between the bobbin and the string are preferably stuck by bonding agent. As shown in Figs., when the ring is attached to the bobbin, the string is put between the pieces 26, 28 and the piece 27 of the hanger and is preferably stuck by bonding agent. As is easily understandable from the above explanation, the struts confronting on the other side of the bobbin are respectively provided in pairs; they may be, however, provided one by one, and the string may be spanned around arms 36, which are formed as frames.

When the voice coil is applied with an electric current, amplitude motion within gap of magnetic path is obtained under a stable condition without any deformation and bias of the voice coil bobbin. And, according to this invention, the spanning of line for the bobbin can be effected surely and easily, enabling mass production of loudspeaker having uniform quality.

Figure 4:
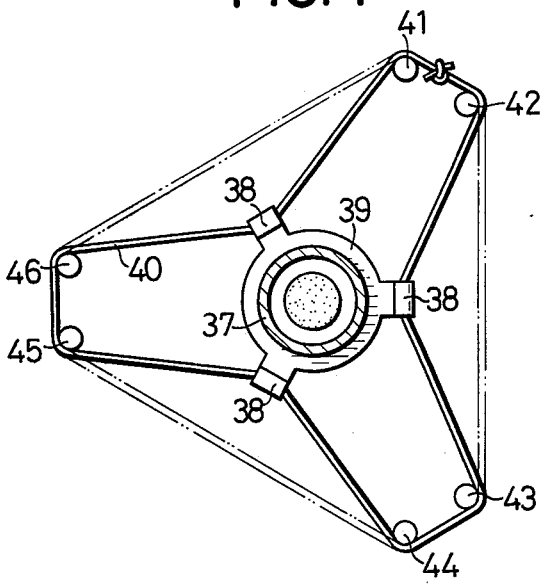
FIG. 4 is a similar section to FIG. 2, showing a variation of spanning a line, wherein the frame, the yoke, and the magnet of loudspeaker are omitted.
Figure 5:
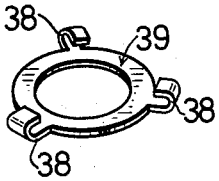
FIG. 5 is a perspective view of a ring to be attached to a voice coil bobbin shown in FIG. 4.

In FIG. 4, there is shown another method for string spanning. On a bobbin 37, a ring 39 (FIG. 5) is secured, which is provided with hook-shaped hangers 38. A string 40 is spanned so as to surround the periphery of struts 41, 42, 43, 44, 45 and 46 which are arranged around the bobbin, and engaged with the hangers 38 of the ring 39 between the struts 42 and 43, the struts 44 and 45, and the struts 46 and 41 respectively on the way of its extension. In this case, when the string is stretched between the struts as shown in an imaginary line in FIG. 4, the central parts of the string are respectively hooked on the hangers, so that the spanning of string can be effected very easily.

Figure 6:
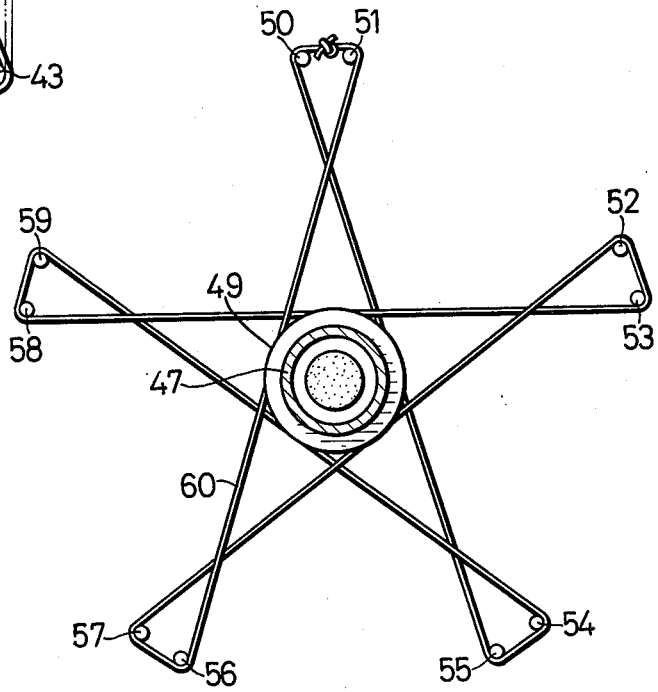
FIG. 6 is a similar section to FIG. 2, showing another variation of spanning a line, wherein the frame, the yoke and the magnet of loudspeaker are omitted.
Figure 7:
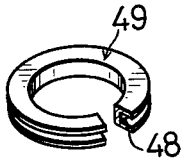
FIG. 7 is a perspective view of a ring to be attached to a voice coil bobbin shown in FIG. 6, with a part thereof being broken.

In FIG. 6, there is shown still another method for string spanning. On a bobbin 47, a ring 49 (FIG. 7) is secured, which is provided with a grooved hanger 48. Struts 50, 51, 52, 53, 54, 55, 56, 57, 58, and 59 are dispersed at five positions under equaldistant condition, so that respective pairs of them are positioned around the bobbin. A string 60 is spanned from the strut 50 to the opposite strut 55 passing by the bobbin 47. And, the string is spanned around the strut 54 adjacent the strut 55 and passing by the bobbin to the opposite strut 59. From the strut 59, the string is spanned around the strut 58 and passing by the bobbin to the opposite strut 53. Then, from the strut 53, the string is spanned around the strut 52 and passing by the bobbin to the opposite strut 57. Finally, the string spanned to the strut 57 is spanned around the strut 56 adjacent the strut 57 and passing by the bobbin to the strut 51. Ends of the string are tied together between the struts 50 and 51. Thus, the bobbin is surrounded by the string spanned in a regular pentagon shape. The string engages with the groove of the hanger of the ring, and the engaged parts are stuck by bonding agent.

In each of the above embodiments, the ends of the line are tied together after the line is spanned; the line, however, may be made as a loop preliminarily to span it around the struts. And the method of spanning the line may be effected in various ways other than those of the above embodiments and the line may be spanned around the bobbin so as to draw a quadrangle, a hexagon and the like.

While the present invention has been described in its several examples, it is understood that the invention is not limited therein, but changes and variations may be made within the spirit of the invention set forth in the following claims.

What I claim is:

1. In a loudspeaker having a frame, a diaphragm attached to the frame, a center pole forming a loudspeaker magnetic field, a voice coil bobbin having a voice coil wound on the periphery thereof for driving said diaphragm in conjunction with said magnetic field and a voice coil support defined by a single suspension line, the improvement comprising:

a plurality of sets of laterally spaced paired struts upstanding on said frame spaced equidistantly from the periphery of said voice coil bobbin, said suspension line having straight line spans interconnecting the pairs of struts with the spans defining an equilateral triangle from which is suspended said bobbin, said line spans of said single line extending along respective planes parallel to planes tangential to said bobbin, and rigid suspension means suspending the voice coil bobbin from said straight line spans of said single line centrally within said equilateral triangle substantially equidistant from said spans.

2. In a loudspeaker according to claim 1, in which said suspension means comprises means enclosing said bobbin circumferentially for suspension thereon and having means for suspending it and the bobbin from said spans.

3. In a loudspeaker according to claim 2, in which said suspension means comprises a rigid, reinforced ring.

4. In a loudspeaker according to claim 1, in which said plurality of struts comprises three pairs of struts, the struts in each pair being laterally spaced in a common plane, and said single line extending across a backside of each of the pairs of struts.

* * * * *